United States Patent [19]

Scheinbaum et al.

[11] 4,278,197

[45] Jul. 14, 1981

[54] CARRY-OUT TRAY

[75] Inventors: Marc C. Scheinbaum, Libertyville; Anne L. Winburn, Lake Forest, both of Ill.

[73] Assignee: Container Corporation of America, Chicago, Ill.

[21] Appl. No.: 124,439

[22] Filed: Feb. 25, 1980

[51] Int. Cl.[3] ..... B65D 5/36

[52] U.S. Cl. ..... 229/30; 229/28 BC

[58] Field of Search ..... 229/30, 28 BC, 52 BC

[56] References Cited

U.S. PATENT DOCUMENTS

| | | | |
|---|---|---|---|
| D. 133,346 | 8/1942 | Marshall, Jr. | 229/28 BC UX |
| 1,968,877 | 8/1934 | Cubberly | 229/52 BC X |
| 2,373,851 | 4/1945 | Potter | 229/28 BC X |
| 2,732,994 | 1/1956 | Anderson, Jr. | 229/28 BC |
| 2,875,940 | 3/1959 | Dunn | 229/30 |
| 3,094,264 | 6/1963 | Petrone | 229/30 X |
| 3,201,024 | 8/1965 | Brokop | 229/30 |
| 3,326,445 | 6/1967 | Goings | 229/30 X |
| 3,780,906 | 12/1973 | Katzenmeyer | 229/28 BC X |
| 4,126,264 | 11/1978 | Cohen | 229/28 BC X |
| 4,156,484 | 5/1979 | Wischen | 229/30 |

FOREIGN PATENT DOCUMENTS

| | | | |
|---|---|---|---|
| 1504754 | 10/1967 | France | 229/28 BC |

*Primary Examiner*—Davis T. Moorhead

*Attorney, Agent, or Firm*—R. W. Carpenter; Davis Chin

[57] ABSTRACT

A collapsible dual compartment carry-out tray formed of paperboard.

9 Claims, 3 Drawing Figures

CARRY-OUT TRAY

SUMMARY OF THE INVENTION

This invention relates to carry-out trays of the type used in restaurants for the transportation of sandwiches, beverages, and other items.

It is an object of this invention to provide a collapsible carry-out tray formed of a unitary blank of foldable sheet material, such as paperboard, and which is provided with a pair of separate compartments.

A more specific object of the invention is the provision of a carry-out tray having a longitudinal extending vertical partition wall separating the beverage compartment from the sandwich compartment of the tray.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

DESCRIPTION OF THE INVENTION

Figure 3:
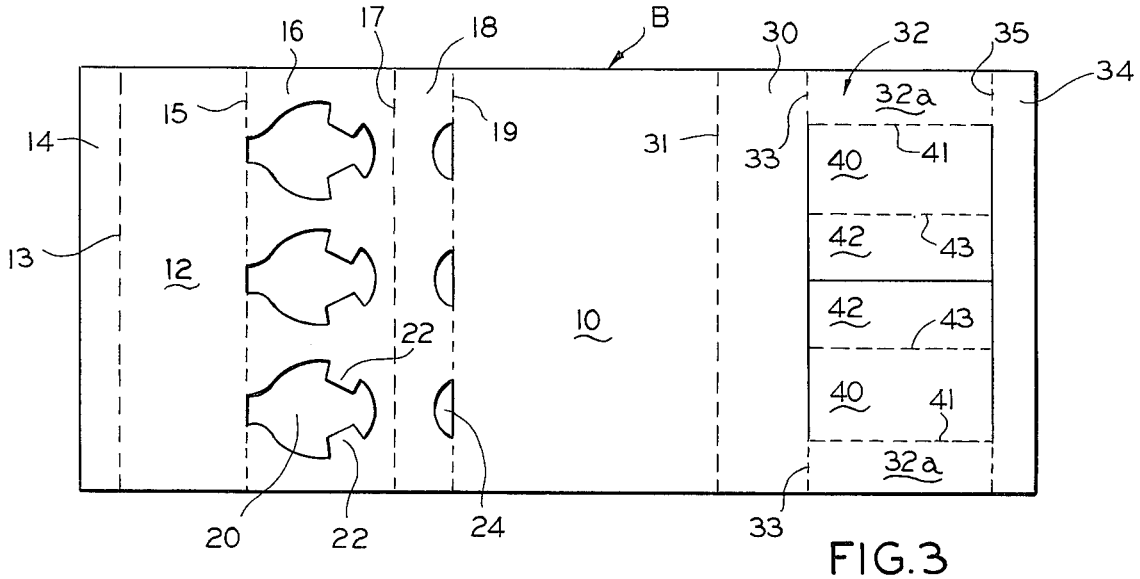
FIG. 3 is a plan view of a blank of material from which the structure illustrated in the other views may be formed.
Figure 1:
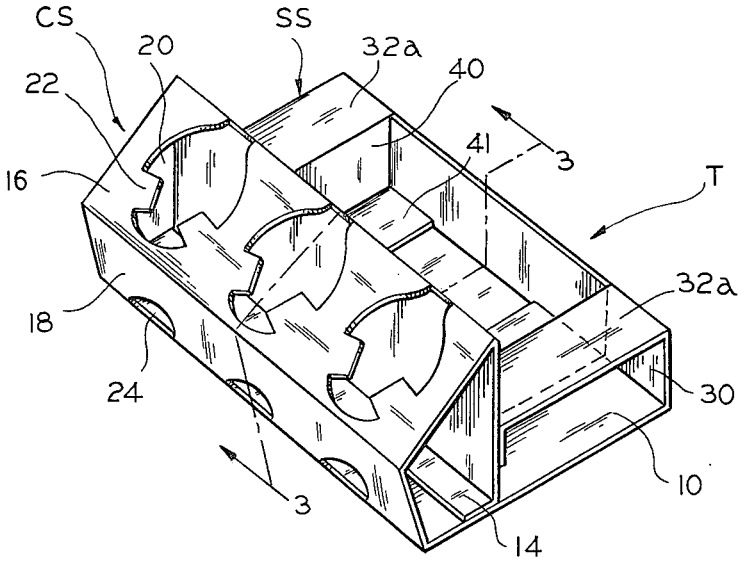
FIG. 1 is a perspective view of a carry-out tray embodying features of the invention.
Figure 2:
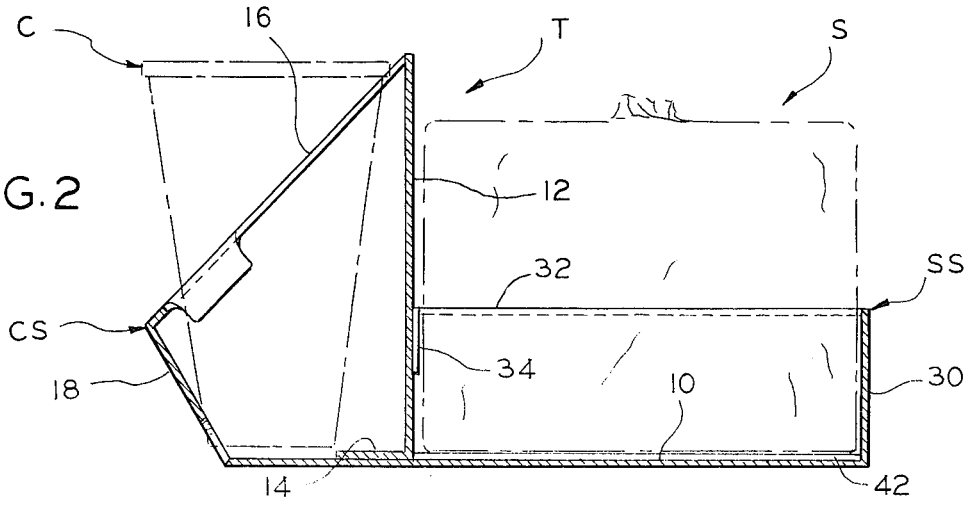
FIG. 2 is a transverse vertical section taken on line 2—2 of FIG. 1.

Referring now to the drawings for a better understanding of the invention, and particularly to FIG. 1, it will be seen that the collapsible carry-out tray, indicated generally at T, may be formed from the unitary blank B of paperboard illustrated in FIG. 3.

The tray includes a pair of separate compartments for carrying a plurality of beverage containers or cups C in one compartment and a bag or sack S of sandwiches or other food items in the other compartment.

Still referring to FIG. 1, it will be seen that a common bottom wall 10, preferably rectangular in shape, underlies both compartments, which compartments are separated from each other by a longitudinally extending vertical, partition wall 12, having foldably joined to its lower edge along fold line 13 a retaining flange 14 which may be secured to the upper surface of bottom wall 10 in any desired manner, such as by adhesive.

The compartment on the left side of the container, as seen in FIG. 1, includes top wall 16 which is foldably joined at its upper edge along fold line 15 to the upper edge of partition wall 12 and which slopes diagonally downwardly and outwardly therefrom. The lower edge of top wall 16 is foldably joined on fold line 17 to the upper edge of front wall 18 which slopes downwardly and inwardly therefrom and which is foldably joined at its lower edge along fold line 19 to the related front side edge of bottom wall 10.

Thus, it will be seen that this compartment is of tubular construction and has a trapezium shaped cross-section.

Top wall 16 is provided with a plurality of openings 20 for receipt of beverage containers within the compartment and may also be provided with a plurality of flexible tabs 22 which project into the openings and are adapted to bear against the beverage containers to hold them firmly in position.

Front wall 18 may also be provided with a plurality of openings 24 which were adapted to receive the lower portions of the beverage containers and prevent sideways movement thereof within the compartment.

Turning now to the other compartment shown on the right side of FIG. 1, it will be seen that the rear wall 30 is foldably joined at its lower edge along fold line 31 to the related rear edge of bottom wall 10 and is disposed to extend upwardly therefrom, preferably in parallel relationship with partition wall 12.

An upper wall 32 spaced above and disposed parallel to bottom wall 10 is foldably joined at its rear edge along fold line 33 to the upper edge of rear wall 30. The other, or inner edge of upper wall 32, is foldably joined along fold line 35 to the upper edge of a flange 34 which may be adhesively secured to the adjacent surface of partition wall 12. Thus, it will be seen that this compartment is also tubular in shape but has a generally rectangular cross-section.

Upper wall 32 comprises a pair of co-planer sections 32(*a*) which are spaced from each other at opposite ends of the tray to define there between an opening to provide access for the interior of the compartment. The ends of the compartment may be closed by a pair of vertical end walls 40 which are foldably joined at their upper edges along fold lines 41 to adjacent inboard edges of respective upper wall sections 32(*a*) and which have foldably joined to their lower edges, along fold lines 43, retaining flanges 42 which are free from connection to the bottom wall, but which are adapted to engage and rest firmly on the upper surface of bottom wall 10 when the tray is in erected condition.

In order to erect the carton from a collapsed condition, top wall 16 is moved upwardly until partition wall 12 is in a vertical position. Then the end walls are depressed and pushed outboardly until they assume a vertical position with flanges 42 engaging bottom wall 10 of the tray.

It will be appreciated that the provision of the vertical partition wall in combination with the non-rectangular cross section of one compartment provides additional strength which permits the use of paperboard material of lower caliper than is conventionally used in carry-out trays of this type. Thus, the invention provides a carton which is much stronger than the conventional carton and yet is less expensive to produce.

We claim:

1. A collapsible carry-out tray having a pair of adjacent compartments separated from each other and being formed from a unitary blank of foldable paperboard or the like, comprising:

(a) a generally rectangular bottom wall extending under both of said compartments;

(b) a longitudinally disposed, vertical partition wall secured to and extending upwardly from said bottom wall intermediate the front and rear sides thereof;

(c) top and front walls foldably joined to each other and to said partition wall and the front edge of said bottom wall, respectively;

(d) said top and front walls being disposed at acute and obtuse angles to the partition and bottom walls, respectively, to define therewith a tubular first compartment structure of generally trapezium shaped cross-section;

(e) upper and rear walls foldably joined to each other and to said partition wall and the rear edge of said bottom wall, respectively;

(f) said upper and rear walls defining with said partition and bottom walls a tubular second compartment;

(g) said top and upper walls having openings therein to provide access to respective compartments.

2. A tray according to to claim 1, wherein said top wall is foldably joined at its upper edge to the upper edge of said partition wall.

3. A tray according to claim 1, wherein said upper wall is foldably joined to a medial portion of said partition wall and to the upper edge of said rear wall.

4. A tray according to claim 1, wherein said second compartment is generally rectangular in cross-section.

5. A tray according to claim 1, wherein said upper wall comprises a pair of co-planer sections spaced from each other to define therebetween an opening for access to said second compartment.

6. A tray according to claim 1, wherein said front wall includes openings in a lower portion thereof for receiving portions of articles contained therein.

7. A tray according to claim 1, wherein said top wall includes flexible tabs projecting into said openings thereof for engagement with articles contained therein.

8. A tray according to claim 5, and including end walls foldably joined at their upper edges to inbroad edges of respective upper wall sections and extending downwardly toward said bottom wall to close the ends of said second compartment.

9. A tray according to claim 1, and including flanges foldably joined to lower edges of respective end walls and disposed to extend normal thereto and in face-to-face engagement with said bottom wall.

* * * * *